United States Patent [19]

Focke et al.

[11] 4,084,627

[45] Apr. 18, 1978

[54] METHOD OF AND APPARATUS FOR DISPENSING TOBACCO PORTIONS

[75] Inventors: Heinz Focke; Oskar Balmer, both of Verden, Aller, Germany

[73] Assignee: Focke & Pfuhl, Verden, Aller, Germany

[21] Appl. No.: 465,944

[22] Filed: May 1, 1974

[30] Foreign Application Priority Data

May 5, 1973 Germany ..... 2322736

[51] Int. Cl.[2] ..... B65B 3/04

[52] U.S. Cl. ..... 141/11; 141/70; 19/304

[58] Field of Search ..... 141/12, 70, 71, 73, 141/98, 129, 7, 8, 69; 19/156.3, 156.4

[56] References Cited

U.S. PATENT DOCUMENTS

| | | | |
|---|---|---|---|
| 3,045,717 | 7/1962 | Vogt | 141/12 |
| 3,179,131 | 4/1965 | Kissling | 141/12 |
| 3,386,372 | 6/1968 | Knipp | 141/12 |

FOREIGN PATENT DOCUMENTS

| | | | |
|---|---|---|---|
| 681,614 | 9/1939 | Germany | 141/129 |

*Primary Examiner*—Houston S. Bell
*Attorney, Agent, or Firm*—Sughrue, Rothwell, Mion, Zinn and Macpeak

[57] ABSTRACT

A method and apparatus is disclosed for dispensing discrete portions of fibrous material, such as tobacco, which is supplied continuously in the form of a fleece or a web. The fibrous material is dispensed in discrete portions which are of a uniform density, by causing the fleece or web to be placed in a container. The uniform density is achieved by injecting air into the fleece or web stream to break up the web and form a uniform density strand by insertion of the fibrous material into the container. Once the container is filled, the strand is severed by a cutter.

11 Claims, 3 Drawing Figures

METHOD OF AND APPARATUS FOR DISPENSING TOBACCO PORTIONS

BACKGROUND OF THE INVENTION

The invention relates to a method of and apparatus for dispensing discrete portions of fibrous material, more particularly tobacco, which is supplied continuously, more particularly as a fleece or web or the like.

A requirement in the processing of smokers tobacco is to divide the tobacco bales as supplied into discrete portions corresponding approximately to the units which are to be packed for sale. The bales first go to a distribution system based on comb belts, scraper rollers and equalizing rollers which carefully remove the long-fibred tobacco from the bale. The tobacco thus removed goes to a conveyor belt; a residue of short-fibred tobacco is either fed simultaneously into the outgoing tobacco fleece or separated out as required and used later as a tare quantity.

SUMMARY OF THE INVENTION

The invention relates to the forming of discrete portions from the continuously supplied fleece or web of tobacco and to the separation and further processing of the dispensed or metered portion.

It is an object of the invention to provide facilities such that portions of tobacco can be formed simply and relatively accurately from the fleece or web, then separated therefrom.

According to the invention, therefore, the tobacco is dispensed volume-wise with a uniform density.

The starting point for the invention is that fairly accurately metered portions can be obtained from the irregular web or fleece by volumetry if the tobacco is introduced into a measuring receptacle, more particularly a measuring chamber, at a uniform density.

For the purposes of the invention, therefore, a tobacco strand in which the tobacco is at a uniform density is formed, and the required portion of tobacco as determined volumetrically by means of the measuring chamber is separated from the uniform-density strand.

To form the uniform-density strand, the irregular supply web or fleece of tobacco is first broken up or substantially broken up by means of the injected air stream. The tobacco fibres removed from the cohering web back up in suspension in the air stream, the backing-up occurring near and beyond the measuring chamber. The resulting back-up or build-up of tobacco is a strand of uniform density.

Other features of the invention relate to the separation of the measured portion from the strand and to further processing of the measured portion.

DESCRIPTION OF THE DRAWINGS

An embodiment of the invention will be described hereinafter in greater detail with reference to the drawings wherein.

DETAILED DESCRIPTION OF THE INVENTION

Figure 1:
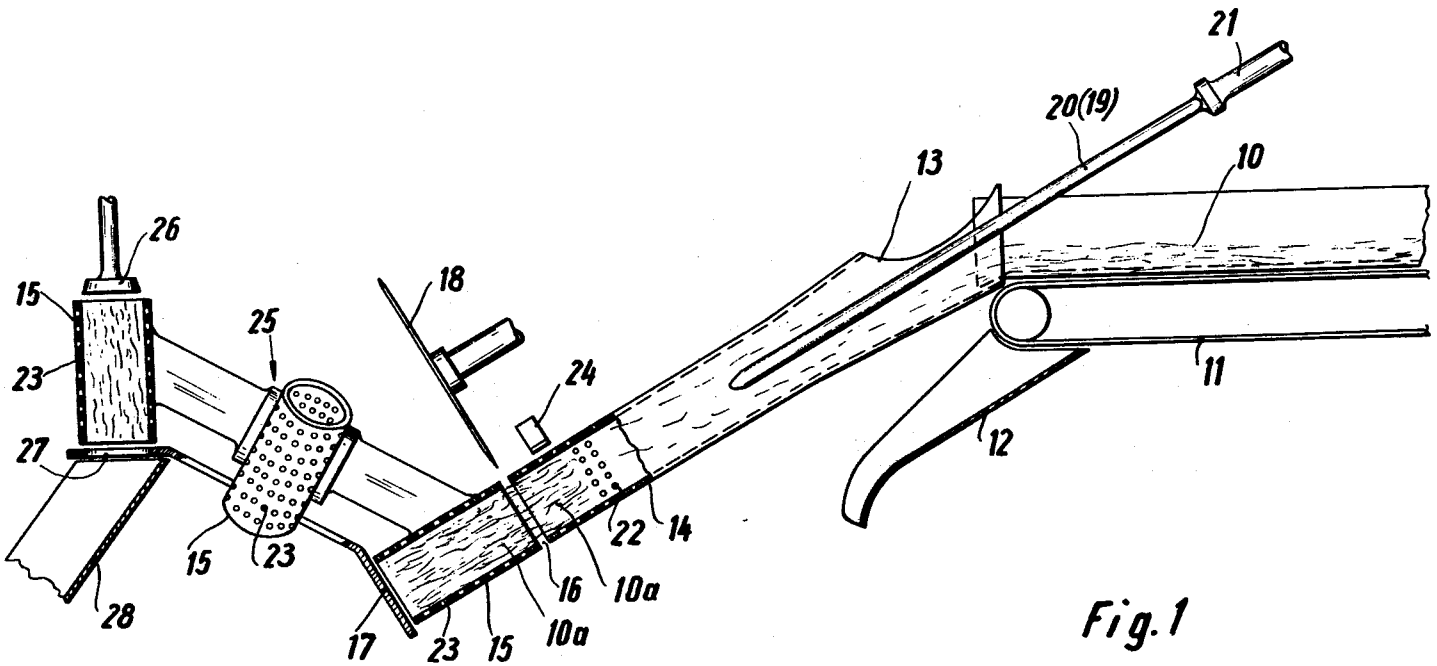
FIG. 1 is a view in side elevation and partly sectioned of a simplified form of apparatus according to the invention.
Figure 2:
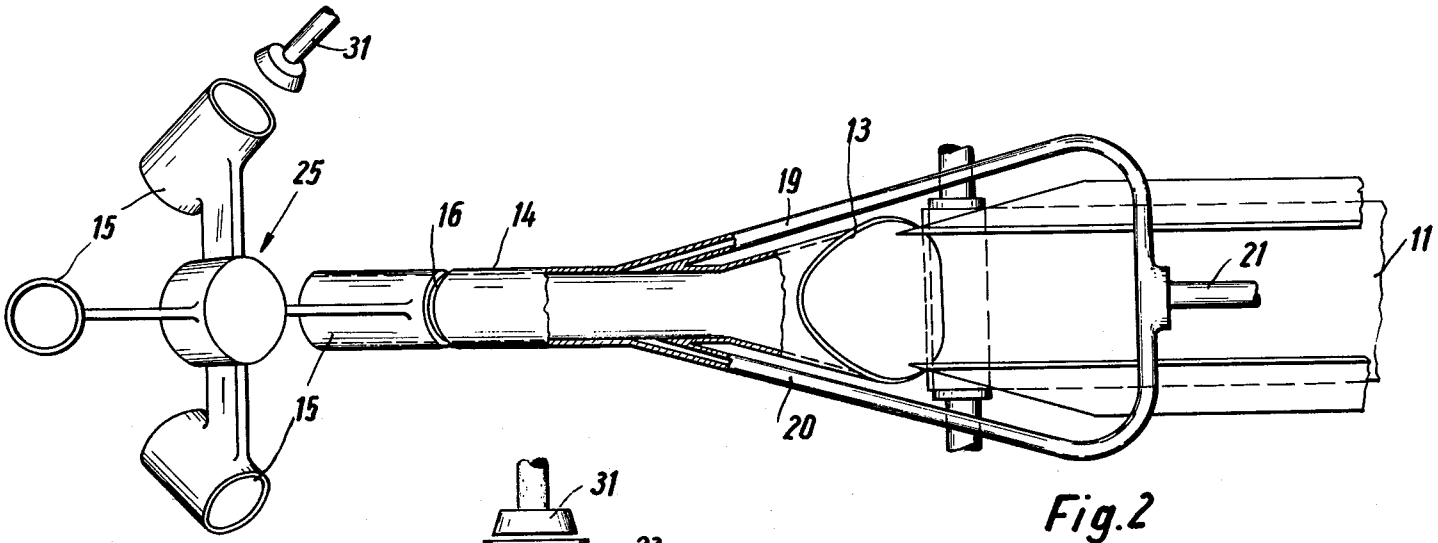
FIG. 2 is a plan view, also in partial section, corresponding to FIG. 1.

The invention as disclosed in the drawings will be described with reference to the treatment of tobacco.

Tobacco which has previously been converted from the form of bales into a continuous stream (fleece or web or the like) 10 is fed continuously on a conveyor — in this case a conveyor belt 11. From belt 11 the tobacco enters a dispensing or metering facility. Any short tobacco which has accumulated on belt 11 is removed via a deflector 12 at the end of the belt 11. The dispensing facility communicates with the belt 11 by way of a feed or entry funnel 13 which merges into a tubular passage 14; disposed after the bottom entry thereof is a measuring chamber 15 which is a separate item from the passage 14.

In the case shown here the measuring chamber 15 comprises a tubular cylindrical member of the same transverse dimensions as the passage 14. In the filling position (station I) the measuring chamber 15 is disposed coaxially of the passage 14 so that the arriving tobacco can go from passage 14 into chamber 15. There is a gap 16 between passage 14 and chamber 15. The base of chamber 15 is a stationary closure plate 17.

The tobacco which builds up or backs up in passage 14 and chamber 15 forms a strand **10*a* which has been uniformly condensed. The required portion of tobacco can therefore be determined by measurement of volume. In the particular example shown, the chamber 15 fills up completely and the compress or condensed strand 10*a* extends beyond the gap 16 into the passage 14. Once the same has been filled to a predetermined extent, the further supply of compressed tobacco is interrupted. The tobacco portion present in the chamber 15 is separated from the following-on part of the strand 10*a*, in this case by a cutter 18 which rotates and which also moves transversely, viz. into the gap 16. The chamber 15 containing the parted-off portion of tobacco is then moved away from the passage 14** and emptied.

The tobacco is supplied to chamber 15 by means of an air flow. Accordingly, the embodiment shown has two injectors 19, 20 which extend into the passage 14 laterally and at an acute angle to the longitudinal axis. In the embodiment shown the two injectors 19, 20 extend to a common air line 21. Each injector 19, 20 injects into the passage 14 a uniform air stream which is directed substantially in the direction of tobacco conveyance.

The first effect of the air flow produced in passage 14 is the production of negative pressure near the funnel 13, the negative pressure drawing the supply web or fleece 10 off the belt 11 into funnel 13 and therefore into passage 14. The air flow then conveys the tobacco along passage 14 and into the measuring chamber 15 where the tobacco accumulates, starting from the end plate 17. The uniform air stream ensures that the tobacco accumulates at a uniform density.

To achieve uniform density of strand **10*a* near chamber 15 and in some of passage 14, the air flow near the funnel 13 and near the entry region of the passage 14 provides some breaking-up of the cohering tobacco fleece 10. The individual tobacco filaments, some of which may still be cohering, are conveyed in the passage 14 in suspension because of the effect of the air stream until they back up near the chamber 15 and near the end of the passage 14. The air flow can discharge laterally near and above the strand 10*a*. To facilitate such discharge in the embodiment shown, the walls of chamber 15 and of some of passage 14 are formed with uniformly distributed orifices 22, 23**.

The orifices 23 in the passage 14 are a means of controlling the dimensions of the tobacco portion, for once the backed-up compressed tobacco has accumulated beyond the apertured portion of passage 14, there is an effect on the air flow and therefore on tobacco feeding.

The apparatus of the embodiment shown is controlled by a sensor 24 which senses or detects the extent of filling of the passage 14 above the gap 16, e.g. by optical means. Once the passage 14 is full of strand 10*a* as far as the senser or detector 24, the tobacco feed is interrupted and the portion of tobacco which has been formed in the measuring chamber 15 is separated from the strand 10*a* following on behind such portion. Conveniently, during this phase infeeding of the tobacco is interrupted by a temporary stoppage of conveyor belt 11.

In the embodiment shown, four measuring chambers 15 are disposed on a common stepwise rotating turret 25. The four chambers 15 also form different stations. In station I the chamber 15 is filled in the manner described. After rotation of the turret through 90° the chamber 15 is checked for proper filling. If the filling is wrong the faulty portion is ejected downwardly (see FIG. 3). In station III the properly filled chamber 15 is emptied by an ejector piston 26 being introduced into it downwardly. The continuous stationary closure plate 17 is formed in this region with an aperture 27 through which the portion of tobacco can be ejected. The ejected portion drops e.g. on to a chute 28 for further processing. Chamber 15 is cleaned at station IV, more particularly by being blown out with air.

Figure 3:
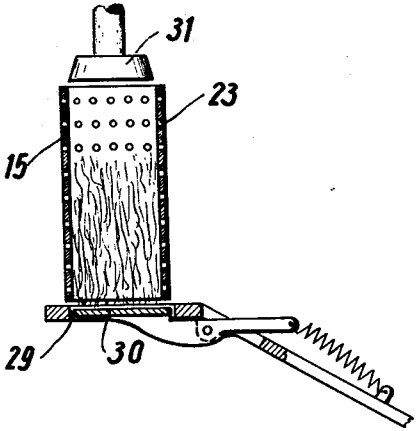
FIG. 3 is a view to an enlarged scale and in a different relative position of part of the apparatus shown in FIGS. 1 and 2.

FIG. 3 shows one possible form for station II; to simplify the drawing the turret 25 is shown pivoted so that the chamber 15, which in fact is in an inclined position in station II, is shown in an upright position.

Near station II the plate 17 is formed below the chamber 15 with an ejection aperture 29 which is closed here by a spring-loaded flap 30. A senser 31 is introduced downwardly into the open chamber 15; if the filling of the chamber 15 is satisfactory, the back-pressure acting on the senser 31 forces it back after it has sensed the portion. If, however, the filling of the chamber 15 is unsatisfactory, the lack of back pressure triggers a signal which makes the senser 31 move through the chamber 15, any residual portion which may be present being ejected downwardly, with simultaneous pivoting of the flap 30.

We claim:

1. In a process for dispensing individual uniform portions of fibrous tobacco material or the like, including the steps of supplying continuously said material as a fleece or web, forming a strand of uniform density, separating said strand into individual portions in a measuring chamber corresponding to the volume of one portion, the improvement wherein the step of forming said strand of fibrous material of uniform density comprises directing an air flow onto said web in the conveying direction of said web towards said measuring chamber and confining the broken up fibrous material downstream of the point of contact of the air flow with the fibrous material web to cause separated material fibers to back up at uniform density.

2. The process as claimed in claim 1, wherein said step of confining the separated fibrous material fibers comprises directing of said separated fibrous material fibers into an air pervious passage closed at one end.

3. The process as claimed in claim 1, further comprising the step of severance of the strand of uniform density separated fibrous material fibers into discrete measured lengths.

4. The process as claimed in claim 2, further comprising the step of severance of the strand of uniform density separated fibrous material fibers into discrete measured lengths.

5. The process as claimed in claim 1, further comprising the step of sensing the density of the fibrous material of the severed strand after removing it from the remaining portion of the strand.

6. An apparatus for dispensing individual uniform portions of a fibrous material fleece or web by forming a strand of material fibers of uniform density and dispensing individual portions of said strand, said apparatus comprising:

a tubular conveying section for said fibrous material, a measuring chamber mounted adjacent to the discharge end of the conveying section for positioning coaxially with respect thereto for receiving the leading end of said strand of uniform density fibrous material, a separating device for separating the contents of the measuring chamber from the succeeding portion of the strand of uniform density fibrous material, said tubular conveying section having an inlet end and means for conveying the fibrous material fleece or web into the inlet end of said tubular conveying section, the improvement comprising:

compressed air nozzle means opening into said tubular conveying section in the direction of said measuring chamber such that the discharge of air from the air nozzles creates suction to cause said fleece or web to move from said inlet toward said outlet and said compressed air nozzles break up said fibrous material web and create within said tubular conveying section and said measuring chamber said fibrous material strand of uniform density.

7. The apparatus as claimed in claim 6, wherein said measuring chamber constitutes a tubular extension of said tubular conveying section and is provided with uniformly distributed apertures within the tubular sidewall of said measuring chamber.

8. The apparatus as claimed in claim 7, wherein said measuring chambers are plural in number and constitute tubular members on a rotatable turret and rotatable between at least a loading station coaxial with said tubular conveying section, and a sensing and discharge station at circumferentially spaced separate positions, and said apparatus further includes closure plate means fixedly overlying the end of said measuring chamber which is coaxial with said tubular conveying section to prevent fibrous material from passing through said measuring chamber at the loading station.

9. The apparatus as claimed in claim 8, further comprising a spring loaded flap positioned at said sensing station for closing off one end of said measuring chamber when said measuring chamber rotates to the measuring station, and sensing means for insertion within the other end of said measuring chamber for sensing the density of fibrous material within said measuring chamber and for permitting said spring loaded flap to open and to discharge said portion of said uniform density strand of fibrous material within said measuring chamber prior to said measuring chamber moving to said discharge station, if the density of the fibrous material is not within predetermined limited.

10. The apparatus as claimed in claim 9, wherein said discharge station comprises an opening within said stationary closure plate overlying a discharge chute and underlying the open end of said measuring chamber when it reaches that station, and said apparatus further comprises an ejector piston mounted coaxially at the opposite end of said measuring chamber for movement into the measuring chamber and forcing said portion of said strand of uniform density fibrous material to be ejected through said aperture within said stationary closure plate onto said chute.

11. The apparatus as claimed in claim 6, wherein said severing means comprises a cutter rotatable about an axis parallel to the longitudinal axis of said tubular conveying section, said measuring chamber is spaced axially from the discharge end of said tubular conveying station, and said rotatable cutter is movable in a direction perpendicular to its axis of rotation and between the spaced ends of said tubular conveying section and said measuring chamber at said loading station for severing said portion of said strand occupying the interior of said measuring chamber.

* * * * *